US006244379B1

(12) United States Patent
Larson

(10) Patent No.: US 6,244,379 B1
(45) Date of Patent: Jun. 12, 2001

(54) SAFETY HARNESS

(75) Inventor: Mikael Larson, Ås (SE)

(73) Assignee: Byggsan Fallskydd AB, Ostersund (SE)

( * ) Notice: Subject to any disclaimer, the term of this patent is extended or adjusted under 35 U.S.C. 154(b) by 0 days.

(21) Appl. No.: 08/930,693

(22) PCT Filed: Apr. 2, 1996

(86) PCT No.: PCT/SE96/00430

§ 371 Date: Oct. 6, 1997

§ 102(e) Date: Oct. 6, 1997

(87) PCT Pub. No.: WO96/31254

PCT Pub. Date: Oct. 10, 1996

(30) Foreign Application Priority Data

Apr. 6, 1995 (SE) ..... 9501283

(51) Int. Cl.[7] ..... A62B 35/00
(52) U.S. Cl. ..... 182/6; 182/7
(58) Field of Search ..... 182/3, 6, 7; 119/857

(56) References Cited

U.S. PATENT DOCUMENTS

| | | | | |
|---|---|---|---|---|
| 3,424,134 | | 1/1969 | Rosenblum . | |
| 5,136,724 | * | 8/1992 | Grilliot | 182/3 |
| 5,145,027 | | 9/1992 | Petzl et al. . | |
| 5,289,590 | | 3/1994 | Larson . | |
| 5,445,114 | * | 8/1995 | Walker | 182/6 |
| 5,615,750 | * | 4/1997 | Phillips | 182/6 |

FOREIGN PATENT DOCUMENTS

| | | | | |
|---|---|---|---|---|
| 3532011 | * | 3/1987 | (DE) | 182/3 |
| 475 859 | | 3/1992 | (EP) . | |
| 477110 | * | 3/1992 | (EP) | 182/3 |
| 2427828 | * | 2/1980 | (FR) | 182/3 |
| 2649618 | * | 1/1991 | (FR) | 182/3 |

* cited by examiner

*Primary Examiner*—Alvin Chin-Shue
(74) *Attorney, Agent, or Firm*—Pillsbury Winthrop LLP

(57) ABSTRACT

An automatically adjustable safety harness, intended to be sewn into a lining which is equipped with fasteners for integration of the lining into a pair of working trousers. The harness has a waist belt which, via two connecting straps with fixed loops and via two position straps, is connected with end loops on two leg straps. The position straps hold the respective leg straps separated from the genitals of the user, and the connecting straps are moveable a predetermined distance relative to the waist belt, whereby the leg straps are movable from a loose, rest position to a tight, working position around the leg of the user, through the corresponding connecting straps being stretched by a force acting on respective fixed loop. The stroke length ensures that the respective leg straps do not tighten too firmly around the legs of the user.

9 Claims, 3 Drawing Sheets

SAFETY HARNESS

This application is the national phase of international application PCT SE96/00430, filed Apr. 2, 1996 which designated the U.S.

BACKGROUND OF THE INVENTION

The invention concerns a safety harness of the type used as a personal fall protection equipment (PFE) in order to provide a reliable fastening point on the body of the user so that it is later easily possible to couple the harness to a system which is anchored to a fixed anchorage point in such a way that the user can be supported by the system or slowed down by the system in a fall situation.

Harnesses can be constructed in different ways, and can be fixed or adjustable, but in order to function safely should be tight fitting under load in order that the force should be distributed to the body parts intended for it. The leg straps, for example, should be tight fitting in order to prevent them clamping around the genitals of the user under load which would be devastating in a braking situation after a fall when the body of the user momentarily can have a deceleration weight of up to 1000 kg.

Furthermore the waist belt should be drawn tight so that the user is held in the harness even if the body in question has ended upside down.

Fixed harnesses are therefore often sold in four to six different sizes so that each user shall be able to find a size which fits him or her. The adjustable harnesses have adjustment arrangements on both the leg straps and the waist belt and, where appropriate, also on the shoulder straps and each harness can be adjusted by means of these adjustment arrangements to fit the respective user when he or she puts it on.

A pair of working trousers with a fixed safety harness of the type mentioned above is described in the Larson, U.S. Pat. No. 3,289,590, issued Mar. 1, 1994 and is incorporated herewith as reference.

For certain groups of users, the tightly fitting harnesses are an inconvenience for most of the time, for example for firefighters, who when turning out usually do not know if they will need a PFE during the current job. Their emergency suits should comprise some sort of PFE which conventionally can consist of a harness of the type shown in SE-C-9001176-8.

Consequently, the firefighter shall always have his or her PFE on during turn-out, which means that the harness is always on even when working with car accidents, forest fires, drowning accidents etc., where it in fact is not needed, as well as with roof work and advanced rope rescues where the harness really proves to be useful.

For the average firefighter, this probably means that he or she does not have need for his or her PFE for 90% of his or her call out time, but however must wear it in the event that the job requires it. A requirement from firefighters is that naturally the harness during turn-out shall restrict freedom of movement as little as possible, which up to now has not been compatible with the requirements for the reliability of the harness which requires that the harness must be tightly fitted in order to fulfill its function in fall situations.

A correctly fitted harness has tight fitting leg straps which means for a firefighter that even when the job takes place at ground level, the firefighter is unnecessarily forced to feel the pressure of the leg straps around his or her legs. In certain situations which require a crouched working position or a crawling movement the harness can be directly obstructive as it tightens around the leg at the hips and diminishes the range of movement.

Similar problems to those described also occur to a certain extent in such work which is performed by for example the police, soldiers, linesmen, building workers, etc.

Another problem especially amongst roofers and the like is that work clothes in the form of, for example, a pair of working trousers are exposed to greater wear than the harness which is protected by the pair of trousers against mechanical wear and ultra violet rays. Because of the comparatively stronger construction of the harness, even if it is exposed to a similar amount of wear as a pair of trousers, it has a longer life than them. Consequently, the life of the harness greatly exceeds the life of a pair of working trousers. Furthermore, because the major part of the total manufacturing costs of a pair of trousers with an integrated harness is due to the harness, it is advantageous if the harness is not fixedly attached to the pair of trousers but it easily transferable from a worn out pair of trousers to a new pair.

SUMMARY OF THE INVENTION

The object of the present invention is therefore is provide a safety harness of the type mentioned which obstructs, as little as possible, the movements of the user during work, no matter whether it takes place at ground level or above, at the same time as the risk of the genitals of the user getting jammed is minimised.

This is achieved according to the invention through the harness having a wrist belt which by means of position straps is joined to the leg straps for the adjustment of them into a position on each leg and which is distanced from the genitals of the user, which is predetermined as a function of the length of the respective position straps, and through each connecting strap being connected to both the waist strap and with the respective leg strap in such a way that each leg strap dependent on the actual load on the fastening loop of the associated connection strap, is maneuverable between an unloaded rest position, where the leg strap lies loosely around the leg and a loaded work position where the leg strap is firmly tightened around the leg.

BRIEF DESCRIPTION OF THE DRAWINGS

A preferred embodiment of the invention is described in more detail in the following description with reference to the appended schematic drawings.

DETAILED DESCRIPTION

Figure 1:
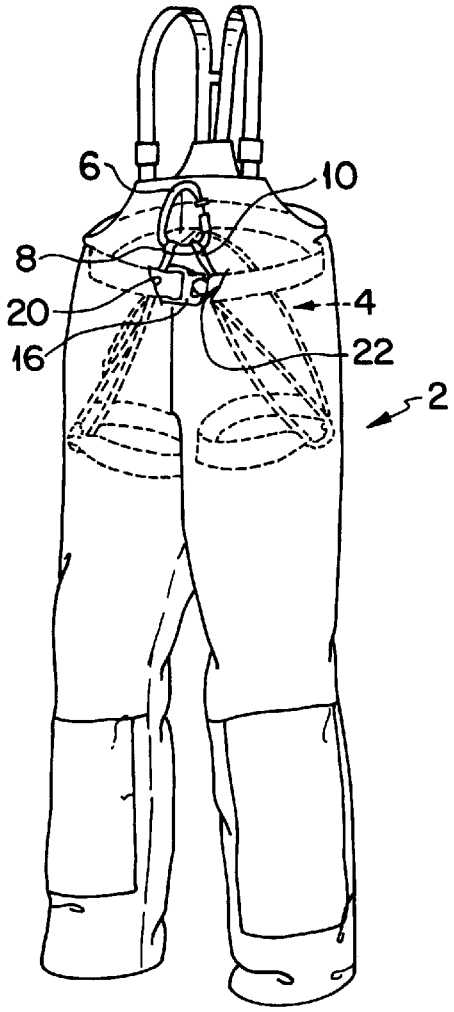
FIG. 1 shows a perspective view of a safety harness integrated into a pair of working trousers.

A pair of working trousers 2 of conventional type is equipped with a safety harness 4, which is removably fastened into the pair of trousers, and which has fastening loops 8 and 10—which are connectable to a coupling means 6, and a waist belt 12. Further details concerning the construction of the harness and the fastening of the harness into the pair of trousers will be described later. The harness is suitably made of polyamide and polyester fibres, which have a long life and high resistance to wear.

The coupling means 6 is intended in the conventional way to be fastened to a not shown fixed anchorage point, for example via an equally not shown safety line.

The waist belt 12 has a catch loop 14 for a buckle 16 at one end and a buckle strap 18 for the buckle at the other end. When a user wears the trousers 2 with the harness 4 the buckle strap 18 is fastened in the buckle and the loop 14 is hooked on the buckle. Each of the fastening loops 8 and 10 and a part of the buckle strap and the catch loop then stick out from the trousers through respective vent openings 20 and 22.

On the inside at the respective end parts of the waist belt 12 there are furthermore respectively first 24 and second 26 running loops formed which lie against the body of the user.

The fastening loops 8 and 10 of the harness are each formed at one end of two similar connecting straps 28 and 30. Each connecting strap is each stitched together from two loops which extend different distances from the respective fastening loops 8; 10. The longer loop forms a tightening loop 32; 34 and the shorter loop forms a stop loop 36; 38 which is fastened inside the corresponding tightening loop. Each connecting strap 28; 30 is intended to join the coupling means 6 on the one hand with the waist belt 12 and the other hand with its leg strap 40; 42 which each have two ends each equipped with a loop, a first end loop 44; 46 and a second end loop 48; 50.

Each leg strap with the corresponding end loops 44; 48 respectively 46; 50 are movably suspended on the corresponding tightening loops 32; 34, which tightening loops are shown in the drawing in an unloaded and loose hanging position, which means that the leg straps similarly are also in an unloaded condition and subsequently are in the rest position.

Figure 2:
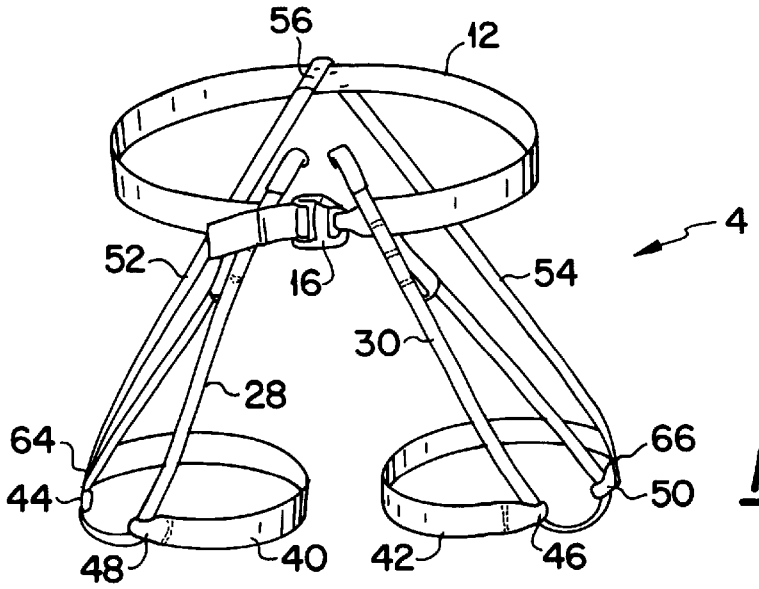
FIG. 2 shows the harness according to FIG. 1 in an enlarged scale.
Figure 3:
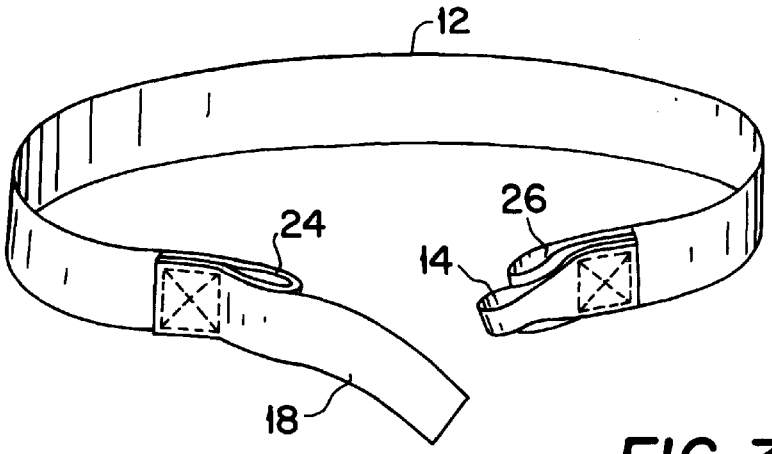
FIG. 3 is a detail sketch of the waist belt of the harness.
Figure 4:
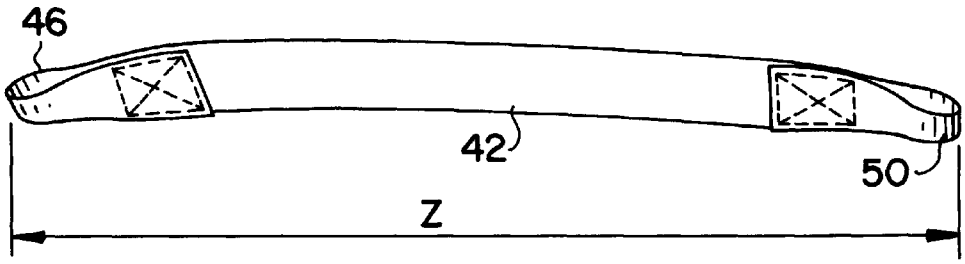
FIG. 4 is a detail sketch of a leg strap of the harness.
Figure 5:
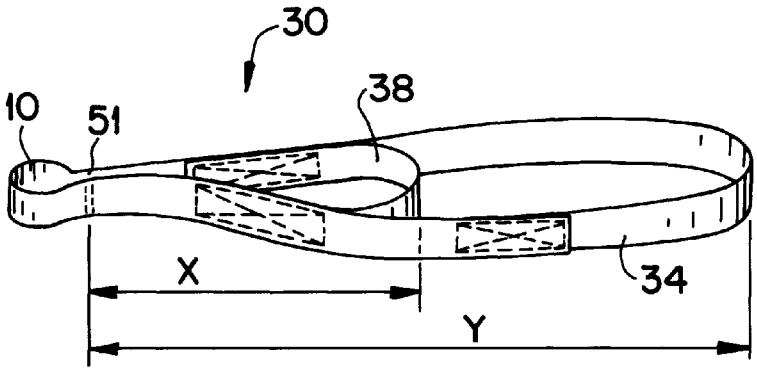
FIG. 5 is a detail sketch of a connecting strap of the harness.
Figure 6:
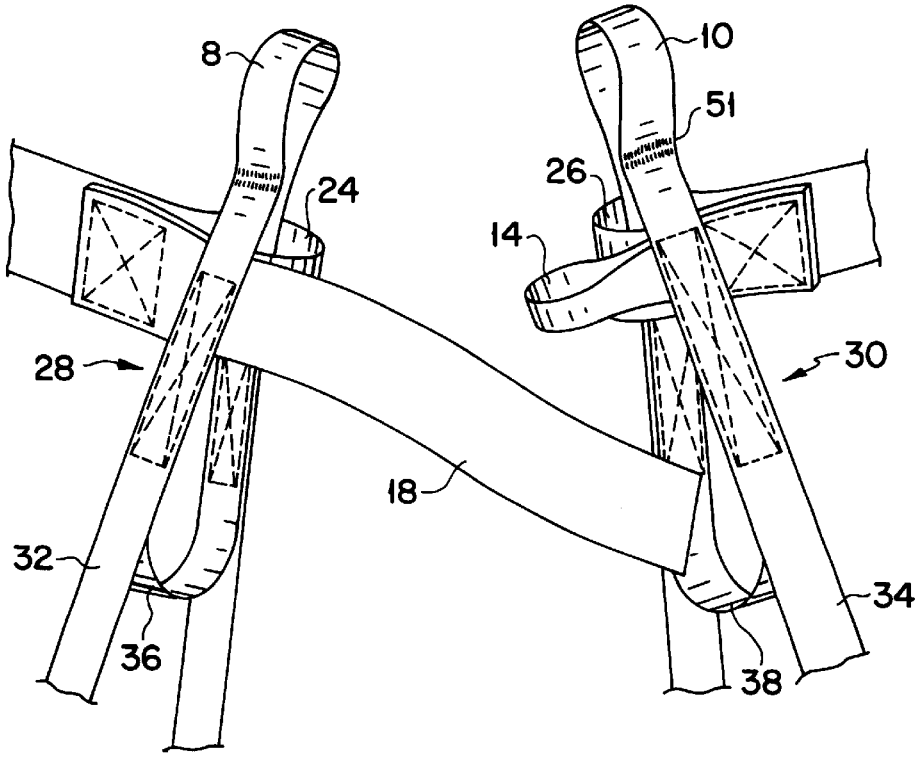
FIG. 6 shows a detail of the coupling of the waist strap with the connection strap.

The connecting straps 28 and 30 are in a similarly analogous way connected to the waist belt 12 by means of its running loops 24 and 26. In order to avoid repetition, this is described only in connection with one connecting strap 30. One part of its tightening loop 34 passes through the running loop 26, in the drawing seen from below and looking upwards, and passes above the running loop in the fastening loop 10, which is formed through transverse seams 51 near the upper end of the connection strap. The fastening loop continues in the other part of the loop 34 downwards on the outside of both loop 26 and the end part of the waist belt, whereby the parts run through each of the end loops 46 respectively 50 of the leg strap and then again connect to each other, as shown at the bottom of FIG. 2, in a sewn together part of the tightening loop, which lies between the end loops 46 and 50.

The stop loop 38 of interest is fastened inside the corresponding tightening loop 34 and at a predetermined distance from the seams 51 which means that the connecting strap is removable in the running loop 26 between a rest position with the seams 51 nearby or resting on the corresponding running loop and a working position when the stretched stop loops at the lower part of the drawing are in contact with the waist belt 12 or the underside of the running loop 26 or with both of them. The distance between the rest position and the working position is consequently established as the distance between the seams 51 and the lower part of the stop loop 38 and is defined as the stroke length of the connecting strap X m.

Whenever each tightening loop 32; 34 is extended under load via the respective fixed loop, the end loops 44, 48 respectively 46, 50 on the corresponding leg straps are forced together, whereby the respective leg straps take up their extended, tightened working positions.

As each connecting strap 28; 30 has a stroke length X m, the corresponding tightening loop will move X m from its rest position to its working position. It is consequently important for proper functioning that each tightening loop also has a fixed length, also measured from the seams 51 and in this case to the lower part of the tightening loop in the extended condition, this length being defined as choke length Y m of the connecting strap. Furthermore, the length of each leg strap 40; 42 in the extended condition is important for the functioning of the harness. This length is defined as the tightening length Z m of the harness.

In order to hold the leg straps 40; 42 separated from the genitals of the user during use of the harness, the harness has position straps 52 and 54, which are best formed in one piece with each other and are fastened on the middle of the waist belt 12 with a common end part 56 which also forms a first fastening point 56. The separate ends of each position strap 52; 54 are fastened in a second fastening point 64; 66 on each of their leg straps, near the first end loop 44 respectively the second end loop 50 and essentially at right angles to the respective leg strap 40 and 42. By varying the length of the position strap is it possible to achieve the required effect on differential sized users. The length of each position strap is defined as the positioning length of the harness P m.

Suitable values for the parameters X, Y, Z and P are as follows:

| User | | Meters | | | |
|---|---|---|---|---|---|
| Length | Weight | X | Y | Z | P |
| 170–180 | 65 | 0.11 | 0.295 | 0.585 | 0.36 |
| 170–190 | 75 | 0.11 | 0.300 | 0.625 | 0.37 |
| 180–200 | 95 | 0.11 | 0.310 | 0.705 | 0.39 |
| 200 | 115 | 0.11 | 0.320 | 0.785 | 0.41 |

Figure 7:
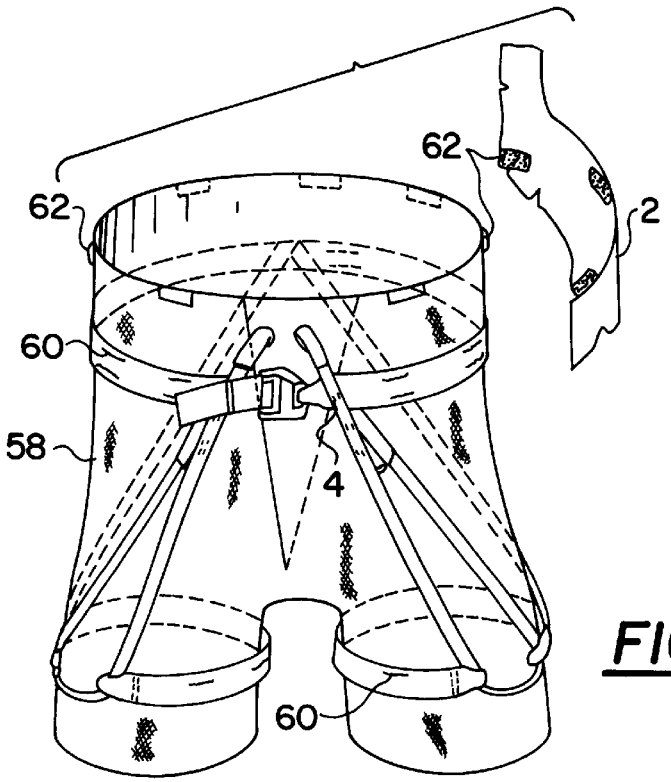
FIG. 7 shows the harness fixed in a lining fastenable into a pair of trousers.

The assembled harness 4 is best fastened on the outside of a lining, which as the shape of a pair of inner trousers 58, by means of sewing 60 at a number of points. In this way, it is easy to fasten a lining equipped with a harness in for example a pair of work trousers 2 without any special knowledge concerning the construction of the harness being required. The lining, which best is made in wide meshed fabric, for example polyester, cotton on a similar material, is fastenable in the pair of trousers by means of fastening means such as, for example, self fastening tape (Velcro® tape) 62. The Velcro® tape is anchored for this purpose by, for example, rivets or sewing on the outside of the lining in the region of its upper edge. Corresponding Velcro® tape is fastened in a corresponding manner at a suitable height on the inside of the pair of trousers 2 as shown in FIG. 7 with a cut-out part 2 of the pair of trousers. Zip fasteners, buttons and button holes or sewing can be used instead of Velcro® tape to fasten the lining 58 with attached harness 4 in the pair of trousers 2.

The first points between the different parts of the harness are best achieved by sewing together. The invention is not limited to the use of the harness inside a pair of work trousers but the harness can also be used separately with or without lining, or together with any sort of working clothes, for example inside an overall, within the scope of the appended claims.

What is claimed is:

1. A safety harness to be worn by a user comprising:

two leg-encircling straps each having a pair of free ends, and arranged to encircle the user's legs;

two connecting straps, respectively loosely connected at a lower end thereof to respective free ends of said leg-encircling straps;

a coupling means arranged to be connected to an anchorage point;

a waist-encircling belt arranged to encircle the user's waist;

each said connecting strap at a respective upper end thereof being loosely connected to said waist-encircling belt and being arranged to be connected via a responsive fastening loop provided at said upper end, to said coupling means;

two positioning straps, respectively joined at a lower end thereof to a respective one of said leg-encircling straps at respective fixed locations remote from most medial regions of said leg-encircling straps, so as to avoid discomforting constraint upon the genitalia of a user, and joined at an upper end thereof to said waist-encircling belt;

each leg-encircling strap being arranged to be movable on a respective leg of a user, depending on loading placed on said fastening loops, between an unloaded, rest position in which the respective leg-encircling strap is arranged to lie loosely around the leg of the user, and a loaded, working position in which the respective leg-encircling strap free ends are drawn closer to each other by respective connecting straps to firmly tighten the respective leg-encircling strap around the respective leg of the user.

2. The safety harness of claim 1, wherein:

each said connecting strap is provided as a three-looped structure having:

an upwardly projecting fastening loop by which the respective connecting strap is arranged to be connected to said coupling means;

a downwardly projecting tightening loop by which the respective connecting strap is connected at said lower end thereof to a respective one of said leg-encircling straps; and a downwardly projecting stop loop which is less than one third as long as the respective tightening loop and transversely loosely encircles the waist-encircling belt, for limiting vertical movement of said connecting strap relative to said waist encircling belt between said unloaded, rest position and said loaded, working position.

3. The safety harness of claim 2, wherein:

said waist-encircling belt is provided with two ends, and a buckle for buckling said two ends together;

each end of said waist-encircling belt being provided with a respective running loop and each said connecting strap stop loop transversely loosely encircling the waist-encircling belt by running through a respective said waist-encircling belt running loop.

4. The safety harness of claim 2, wherein:

each said leg-encircling strap is provided as a strap having a loop at each said free ends thereof; and the respective said tightening loop of each said connecting strap is connected to a respective said leg-encircling strap by running through both of said loops provided at said free ends of the respective said leg-encircling strap.

5. The safety harness of claim 3, wherein:

said position straps are joined at said upper ends thereof to said waist-encircling belt at a location that is substantially midway between said two ends of said waist-encircling belt.

6. The safety harness of claim 1, further including:

a trouser liner having a trunk portion joined to two respective thigh portions;

said waist-encircling belt being fixed to said trunk portion; and said positioning straps and said leg encircling straps being fixed to respective ones of said thigh portions.

7. The safety harness of claim 6, further including:

a pair of working trousers;

said trouser liner being removably mounted by connectors to said pair of working trousers as a lining therefor.

8. The safety harness of claim 7, wherein:

said connectors removably mounting said trouser liner to said pair of working trousers are provided by a plurality of sets of removably connected hook and loop fasteners.

9. A safety harness to be worn by a user comprising:

two leg-encircled straps each having a pair of free ends, and arranged to encircle the user's legs;

two connecting straps, respectively loosely connected at a lower end thereof to respective free ends of said leg-encircling straps;

a coupling means arranged to be connected to an anchorage point;

a waist-encircling belt arranged to encircle the user's waist;

each said connecting strap at a respective upper end thereof being movable relative to said waist-encircling belt and being arranged to be connected, via a respective fastening loop provided at said upper end, to said coupling means; and two positioning straps, respectively joined at a lower end thereof to a respective one of said leg-encircling straps at respective fixed locations remote from most medial regions of said leg-encircling straps, so as to avoid discomforting constraint upon the genitalia of a user, and joined at an upper end thereof to said waist-encircling belt;

each leg-encircling strap being arranged to be movable on a respective leg of a user, depending on loading placed on said fastening loops, between an unloaded, rest position in which the respective leg-encircling strap is arranged to lie loosely around the leg of the user, and a loaded, working position in which the respective leg-encircling strap free ends are drawn closer to each other by respective connecting straps to firmly tighten the respective leg encircling strap around the respective leg of the user.

* * * * *